US008764115B2

(12) United States Patent
Brandtner

(10) Patent No.: US 8,764,115 B2
(45) Date of Patent: Jul. 1, 2014

(54) FURNITURE WITH DECORATIVE FASTENERS

(75) Inventor: Timothy A. Brandtner, Ettrick, WI (US)

(73) Assignee: Ashley Furniture Industries, Inc., Arcadia, WI (US)

( * ) Notice: Subject to any disclaimer, the term of this patent is extended or adjusted under 35 U.S.C. 154(b) by 1432 days.

(21) Appl. No.: 12/138,328

(22) Filed: Jun. 12, 2008

(65) Prior Publication Data

US 2008/0309145 A1 Dec. 18, 2008

Related U.S. Application Data

(60) Provisional application No. 60/934,818, filed on Jun. 15, 2007.

(51) Int. Cl.
*A47C 7/18* (2006.01)

(52) U.S. Cl.
USPC ..... 297/452.38; 297/452.59; 297/452.6

(58) Field of Classification Search
CPC ..... A47B 83/04; B60N 2/5825; A47C 7/40
USPC ..... 297/218.1–218.3, 452.58–452.59, 297/440.1, 440.14, 452.38, 452.6, 218.5
See application file for complete search history.

(56) References Cited

U.S. PATENT DOCUMENTS

| | | | | |
|---|---|---|---|---|
| 2,170,224 | A * | 8/1939 | Tarr | 297/218.3 |
| 3,170,729 | A * | 2/1965 | Grant | 297/440.15 |
| 3,408,105 | A * | 10/1968 | Portell | 297/452.58 |
| 3,696,771 | A | 10/1972 | Ambrose | |
| 3,733,658 | A | 5/1973 | Mitchell | |
| 3,900,143 | A | 8/1975 | Gallman | |
| 4,080,675 | A * | 3/1978 | Kanowsky et al. | 297/452.58 |
| 4,158,251 | A | 6/1979 | Howell | |
| 4,185,367 | A | 1/1980 | Puchy | |
| 4,225,179 | A * | 9/1980 | Oltrona Visconti | 297/219.1 |
| 4,458,387 | A * | 7/1984 | Pearson | 24/101 B |
| 4,559,683 | A * | 12/1985 | Webb, Jr. | 29/91.1 |
| 4,662,033 | A * | 5/1987 | Wieland et al. | 24/114.4 |
| 4,751,038 | A | 6/1988 | Schlueter et al. | |
| 4,943,197 | A | 7/1990 | Baritz | |
| 5,031,262 | A | 7/1991 | Baritz | |

(Continued)

FOREIGN PATENT DOCUMENTS

| | | |
|---|---|---|
| CN | 2343864 | 10/1999 |
| EP | 1 312 811 A1 | 5/2003 |

(Continued)

*Primary Examiner* — David R Dunn
*Assistant Examiner* — Jody Giacoman
(74) *Attorney, Agent, or Firm* — Christensen Fonder P.A.

(57) ABSTRACT

A method of assembling an upholstered furniture piece comprising decorative fasteners comprising providing an underlayment material layer, a foam material layer and a covering material layer. The foam material layer is positioned between the underlayment material layer and the covering material layer. The covering material layer extends beyond the underlayment material layer and the foam material layer. Fasteners are used to fasten the underlayment material layer, the foam material layer and the covering material layer together forming a layered component. A template may be used to guide positioning of the fasteners. The fasteners are decorative fasteners. Excess covering material that extends beyond the fasteners is stretched around the edges of the layered component and is affixed to a bottom surface of the layered component, thereby forming a layered assembly. The layered assembly is affixed to an upholstered furniture piece.

7 Claims, 12 Drawing Sheets

(56) References Cited

U.S. PATENT DOCUMENTS

| | | | | |
|---|---|---|---|---|
| 5,130,510 | A | 7/1992 | Zeigler et al. | |
| 5,309,612 | A | 5/1994 | Briere et al. | |
| 5,360,639 | A | 11/1994 | Kawabata | |
| 5,433,571 | A | 7/1995 | Allison | |
| 5,513,935 | A * | 5/1996 | Sharber et al. | 411/480 |
| 5,517,730 | A | 5/1996 | Ho | |
| 5,685,174 | A | 11/1997 | Balzer et al. | |
| 6,247,209 | B1 | 6/2001 | Pferdehirt | |
| 6,568,058 | B1 * | 5/2003 | Wieland et al. | 29/91.1 |
| 6,827,539 | B2 | 12/2004 | Somers et al. | |
| 7,988,236 | B2 * | 8/2011 | Brandtner | 297/440.1 |
| 2008/0150334 | A1 * | 6/2008 | Callaghan | 297/218.3 |

FOREIGN PATENT DOCUMENTS

| | | |
|---|---|---|
| GB | 2 184 648 A | 7/1987 |
| JP | 8-284520 | 10/1996 |
| JP | 10-113242 | 5/1998 |

* cited by examiner

FURNITURE WITH DECORATIVE FASTENERS

PRIORITY CLAIM

The present application claims priority to U.S. Provisional Application Ser. No. 60/934,818 filed Jun. 15, 2007, and entitled "FURNITURE WITH DECORATIVE FASTENERS", which is hereby incorporated by reference in its entirety.

FIELD OF THE INVENTION

The disclosure relates to furniture construction, and in particular, to the manufacture of furniture that utilizes decorative fasteners. More specifically, the disclosure relates to the preparation of pre-assembled furniture components comprising decorative fasteners.

BACKGROUND OF THE INVENTION

In the manufacture of upholstered furniture, such as sofas and chairs, it is often desirable to use decorative fasteners, such as decorative nails or tacks, to affix the upholstery to the frame of the furniture product. The use of decorative fasteners to affix upholstery to the furniture product provides the opportunity to create a certain desired aesthetically pleasing appearance. For example, leather and imitation leather upholstery may be affixed to a furniture frame by using decorative fasteners that include a brass colored fastener cap, to provide a rich, elegant and yet casual appearance to the furniture product. Further, a matching fabric covered fastener cap can provide an elegant and unobtrusive fastening device, or if covered in a complementary material, can provide an attractive accent to the upholstered furniture product.

Further, in the manufacture of upholstered chairs, sofas, and the like, a finished upholstered panel may be affixed to the upholstered chair or sofa, as a step in the manufacturing because, for example, a finished furniture product will generally include decorative fasteners, as compared to a furniture component, such as the upholstered panels described above.

SUMMARY OF THE INVENTION

The disclosure addresses the need of the industry for a cost-effective and efficient way of providing furniture products that comprise decorative fasteners. More particularly, the disclosure describes a furniture product, and method of making a furniture product, wherein the decorative fasteners can be applied to a furniture component in one location and the furniture component can be efficiently and safely shipped and incorporated in the assembled furniture product.

In one embodiment, a furniture component, for example a sofa or chair arm panel or front rail panel, can be constructed utilizing decorative fasteners, for example, decorative rivets, nails, tacks, or brads, wherein the decorative fasteners hold together the various elements of the furniture component in an integral whole. The chair arm panel, for example, is produced wherein the backer board of the chair arm panel is mated to a finished decoratively fastened front panel, such that the chair arm panel is ready to be affixed to the front surface of an arm of an upholstered chair. The chair arm panel includes protruding fastener prongs in the rear surface of the panel, so that the protruding fastener prongs, for example, panel nail ends, are used to affix the chair arm panel to the furniture frame, in this instance a front surface of an arm of an upholstered chair. The chair arm panel can be shipped in this form for assembly to a seat or sofa frame at another location.

Alternatively, decorative fasteners are arranged on the furniture component, for example a chair arm panel, so that some spaces that can be occupied by a decorative fastener are left vacant. The decorative fasteners, nevertheless, hold the furniture component together so that it process. Finished upholstered panels can be manufactured without the use of decorative fasteners, and then the panel can be affixed to the furniture product using decorative nails or decorative tacks. The decorative nail or decorative tack can be used to affix finished upholstered panels to, for example, the front of arms, the front rails, on the outer sides of arms, to top back rails, and to complete backs of the furniture product. Hence, an upholstered panel could be manufactured in a low labor cost region and the panel could be shipped to a final destination for assembly into a completed furniture product, in those instances where the location of manufacture is not close to the place of sale. The application of many decorative nails or decorative tacks may be a time-consuming activity and more economically accomplished in a low labor cost location. Generally, sofas with exposed nail heads are both functional in holding the upholstery onto the sofa frame and decorative with the rounded heads exposed. These fasteners currently must be installed individually as, for example, the front panel on the front face of the sofa, and are installed directly into the furniture frame Such application of decorative fasteners, for example, decorative nails, can be a time-consuming process, is very tedious, and is difficult to get the decorative rounded heads perfectly spaced and positioned. As noted above, it may be cost-effective to manufacture the upholstered furniture product where labor costs are low. Typically, the desire for lower labor costs requires that manufacturing be moved overseas to lower labor cost markets. Then, the cost impact of affixing the volume of decorative fasteners can be managed and potentially minimized. However, the benefit of lower labor costs in association with affixing decorative fasteners may need to be considered in light of the consequence that generally finished furniture products may need to be shipped instead of unassembled or partially assembled furniture products. This is can be transported and manipulated without the furniture component being damaged or falling apart. The furniture component does not include protruding prongs emanating from the rear surface of the furniture component. When the final furniture product is to be manufactured, the furniture component, for example, an upholstered chair front panel, is positioned in place and decorative fasteners are used to affix the panel to the chair frame. The decorative fasteners used to affix the component to the furniture frame occupy the positions left vacant when the component was being assembled. Alternatively, fasteners that are not visible on the exterior of the furniture product can be used to affix the furniture component to the furniture frame. This type of fastener is especially useful when the positions available for decorative fasteners were used by decorative fasteners during assembly of the furniture component, but fasteners are still required to affix the component to the furniture frame.

In another embodiment, an upholstery cover, for example, for a chair or a sofa, is supplied wherein the upholstery cover comprises a plurality of decorative fasteners, where some of the positions which should be held by the decorative fasteners are left vacant. The upholstery cover for the back of a chair or sofa comprises a plurality of shaped cover material pieces stitched together to form the upholstery cover. The upholstery cover is designed to fit over cushioning material on the back of a chair or sofa and to be affixed to the back top of a chair frame or sofa frame, respectively. It is desired that a plurality of decorative fasteners be positioned along the back top of the chair or the sofa, to provide for an aesthetically pleasing furniture product.

Alternatively, fasteners that are not visible on the exterior of the furniture product can be used to affix the upholstery cover to the furniture frame. This type of fastener is especially useful when the positions available for decorative fasteners were used by decorative fasteners during assembly of the upholstery cover, but fasteners are still required to affix the upholstery cover to the furniture frame.

Hence, a furniture component, including an upholstery cover, comprising decorative fasteners, for example, decorative rivets, tacks, brads, or nails, can be efficiently and economically manufactured, packaged in cases or cartons, transported, unpacked, and affixed to a furniture product to complete the furniture product. Generally, the furniture components are transported at least 1,000 miles to another geographic location, for assembly to the furniture product.

Other aspects of the invention may be described as follows: A method of manufacturing a preassembled upholstered component with exposed metal decorative rounded heads for later attachment to a wood furniture frame as part of the assembly process of an upholstered piece of the furniture, the method comprising:

layering a layered assembly comprising foam positioned intermediate a piece of upholstery covering material and a backing board, the backing board being thin and flat and having a shape with an edge and having a front side and a back side; and inserting a multiplicity of fasteners through the layers of upholstery covering material, the layer of foam, and the backing board in a series to follow along the backing board edge and spaced from the edge whereby the layers of upholstery covering material, the layer of foam, and the backing board are compressed, the fasteners each having a decorative rounded exposed head.

The fastener may comprises a rivet.

The piece of upholstery covering material may have an edge and maybe shaped to correspond to the shape of the backing board and the method further may comprise the step of folding the edge of the upholstery covering material around the edge of the backing board and securing the edge of the upholstery covering.

The method may further comprise the steps of securing a plurality of fasteners with prongs extending from one side of a second board, the second board having a shape that corresponds to the first board.

The method may further comprise attaching a plurality of fasteners including prongs to the layered assembly whereby the prongs extend from a side of upholstered component opposite the side from the decorative rounded exposed heads.

The method may further have the layering of the layered assembly comprising the step of placing the upholstery covering material, the layer of foam, and the backing board on a template before inserting the multiplicity of fasteners sized to receive same.

The method may further have the template with a pattern corresponding to the desired positions of fasteners to be applied and the step of inserting a multiplicity of fasteners includes the step of utilizing a powered fastener inserter with a guide to follow the pattern of the template as the fasteners are being inserted.

The method may further comprise the step of utilizing a template and a powered fastener applicator to position the fasteners where desired.

A method of manufacturing upholstered furniture, the method of manufacturing furniture including a method of securing a series of decorative rounded heads on a upholstered component, the upholstered component having an elongate flat panelar shape configured to be attached to the front face of an arm of an upholstered seat, the method of securing the series decorative rounded heads on the upholstered component comprising the steps of inserting of a layered assembly into a template having a pattern that corresponds to desired fastener locations, the layered assembly including a piece of upholstery material with a shape that corresponds to the elongate flat panelar shape of the upholstered component, engaging the template on a powered fastener applicator with a table and engagement piece that engages the pattern, moving the template on the fastener applicator with the engagement piece following the pattern as the fasteners are being inserted by the fastener applicator, the fasteners each having the decorative rounded head.

This method may have the template with a top side and a bottom side with the top side having a recess for receiving the layered assembly and the bottom side having the pattern.

This method may further comprising the step of inserting a plurality of fasteners with prongs to the layered assembly on a side opposite the decorative rounded heads.

The method of manufacturing upholstered furniture further comprising the step of assembling a multiplicity of the upholstered furniture pieces at a first location and shipping said pieces in a container to a second location where the pieces are then attached to wood seat frames with wood fasteners.

The method of manufacturing upholstered furniture may also have the wood fasteners installed at the first location.

This method may also have the wood fasteners installed at the second location and said wood fasteners have a decorative rounded head that matches the decorative rounded heads of the fasteners installed at the first location.

This method may also include shipping said pieces in the container to a second location comprising travel of at least 1000 miles.

A method of assembling manufacturing upholstered furniture pieces, the method comprising the steps of manufacturing a multiplicity of preassembled upholstered components with exposed metal decorative rounded heads at a first location, and shipping the multiplicity of preassembled upholstered components to a second location for attachment to wood furniture frames of the upholstered furniture pieces, and wherein the method of manufacturing each preassembled upholstered component comprises:

sandwiching a layer of foam between an upholstery covering material and a backing board between the upholstery and backing board, the backing board being thin and flat and having a shape with an edge and having a front side and a back side;

inserting a multiplicity of fasteners in a an ordered sequence through the layers of upholstery covering material, the layer of foam, and the backing to follow along the backing board edge and spaced from the edge, the fasteners each having a rounded head, the rounded head having a first side with a decorative exposed surface and a second side for engaging the upholstered covering material;

This method may also have the fasteners each including a prong extending from the second side of the rounded head and the method further comprises deforming the prongs as the fasteners are inserted.

A template for assembling an upholstered component, the upholstered component having an upholstery covering and a panelar geometric shape with an edge, a series of decorative metallic rounded heads arranged to follow the geometric shape, the decorative metallic rounded fastener heads spaced from the edge, the template having a top side and a bottom side, the bottom side having a pattern that corresponds to the desired fastener locations, the top side having a recess for receiving at least one layer of material that is shaped to correspond to the geometric shape of the upholstered component, the top side having a plurality of perimeter prongs extending upwardly to secure upholstered covering material.

An upholstered component for assembly of an upholstered seat and placement on the front face of a seat, the upholstered component having a front side and a back side, an upholstery covering and a panelar geometric shape with an edge, a series of decorative metallic rounded fastener heads arranged to follow the geometric shape, a central area that bulges outwardly from a cushion material below the upholstery covering, the component secured together by the fasteners extending at least partially through the component and securing the component together, the upholstery covering extending over the front side and wrapped partially onto the back side of the component and secured thereto, a plurality of fasteners with prongs extend outwardly from the back side for future installation on a wood seat frame.

This component may also have the fasteners with prongs extending outwardly have a base component attached to a board within the component said base component not exteriorly visible.

A method of assembling an upholstered furniture piece comprising a line of decorative fasteners comprising:

providing an underlayment material layer, a foam material layer and a covering material layer wherein the foam material layer is positioned between the underlayment material layer and the covering material layer, and the covering material layer extends beyond the underlayment material layer and the foam material layer;

fastening the underlayment material layer, the foam material layer and the covering material layer together forming a layered component with fasteners, wherein the fasteners are decorative fasteners and excess covering material extends beyond the underlayment material;

stretching the excess covering material around the edges of the layered component;

affixing the excess covering material to a bottom surface of the layered component thereby forming a layered assembly; and affixing the layered assembly to an upholstered furniture piece.

This method may also have the underlayment material layer and the foam material layer affixed together, prior to being fastened to the covering material layer.

This method may also have the underlayment material layer and the foam material layer placed in a template.

This method may also have the covering material layer temporarily affixed to a top surface of the template.

This method may also have the template providing guides for positioning the decorative fasteners in the layered composition.

This method may also have the layered composition removed from the template and affixed to the backer board, forming a layered assembly.

This method may also have the backer board comprising a plurality of fasteners wherein each fastener includes a tapered shaft and the tapered shafts extend from the backer board.

This method may also have the tapered shafts affix the layered assembly to the upholstered furniture piece.

This method may also have the upholstered furniture piece is selected from the group consisting of a sofa and a chair.

This method may also comprise providing a backer board and affixing the backer board to the underlayment material layer and forming a layered composition.

This method may also comprise affixing the excess covering material to a bottom surface of the layered composition thereby forming a layered assembly.

An upholstered furniture piece comprising decorative fasteners comprising:

a layered component comprising an underlayment material layer, a foam material layer and a covering material layer, wherein the foam material layer is positioned between the underlayment material layer and the covering material layer, and decorative fasteners wherein the decorative fasteners affix the covering material layer to the foam material layer and underlayment layer; and an upholstered furniture piece frame, wherein the layered component is affixed to the upholstered furniture frame.

This piece may also have the layered component further comprising a backer board affixed to the underlayment material layer, thereby forming a layered composition.

This piece may have the layered composition affixed to an upholstered furniture frame.

A method of manufacturing upholstered furniture pieces comprising:

a) assembling a layered composition capable of receiving a decorative rivet;

b) attaching a plurality of decorative rivets to the layered composition, forming a layered assembly;

c) packing a plurality of layered assemblies into shipping cartons at a first geographic location;

d) unpacking the layered assemblies at a second geographic location at least 1,000 miles from the first geographic location;

e) attaching the layered assemblies with decorative fasteners to a plurality of furniture frames.

This method may also have the layered composition assembled by layering an underlayment material layer, a foam material layer and a covering material layer, wherein the foam material layer is positioned between the underlayment material layer and the covering material layer.

This method may also have the decorative rivets attached to the layered composition by placing the layered composition in a template and using the template to guide the placement of the decorative rivets.

This method may also comprise affixing a backer board to the underlayment material layer.

This method may also have the layered assembly as an upholstery cover.

This method may also have the layered assembly be a furniture panel selected from the group consisting of a sofa arm panel, a chair arm panel, a sofa rail panel, a chair rail panel, a chair top panel, and a sofa top panel.

"Multiplicity" when used herein means more than a dozen.

BRIEF DESCRIPTION OF THE DRAWINGS

These as well as other objects and advantages of this invention, will be more completely understood and appreciated by referring to the following more detailed description of the presently preferred exemplary embodiments of the invention in conjunction with the accompanying drawings of which.

Figure 1:
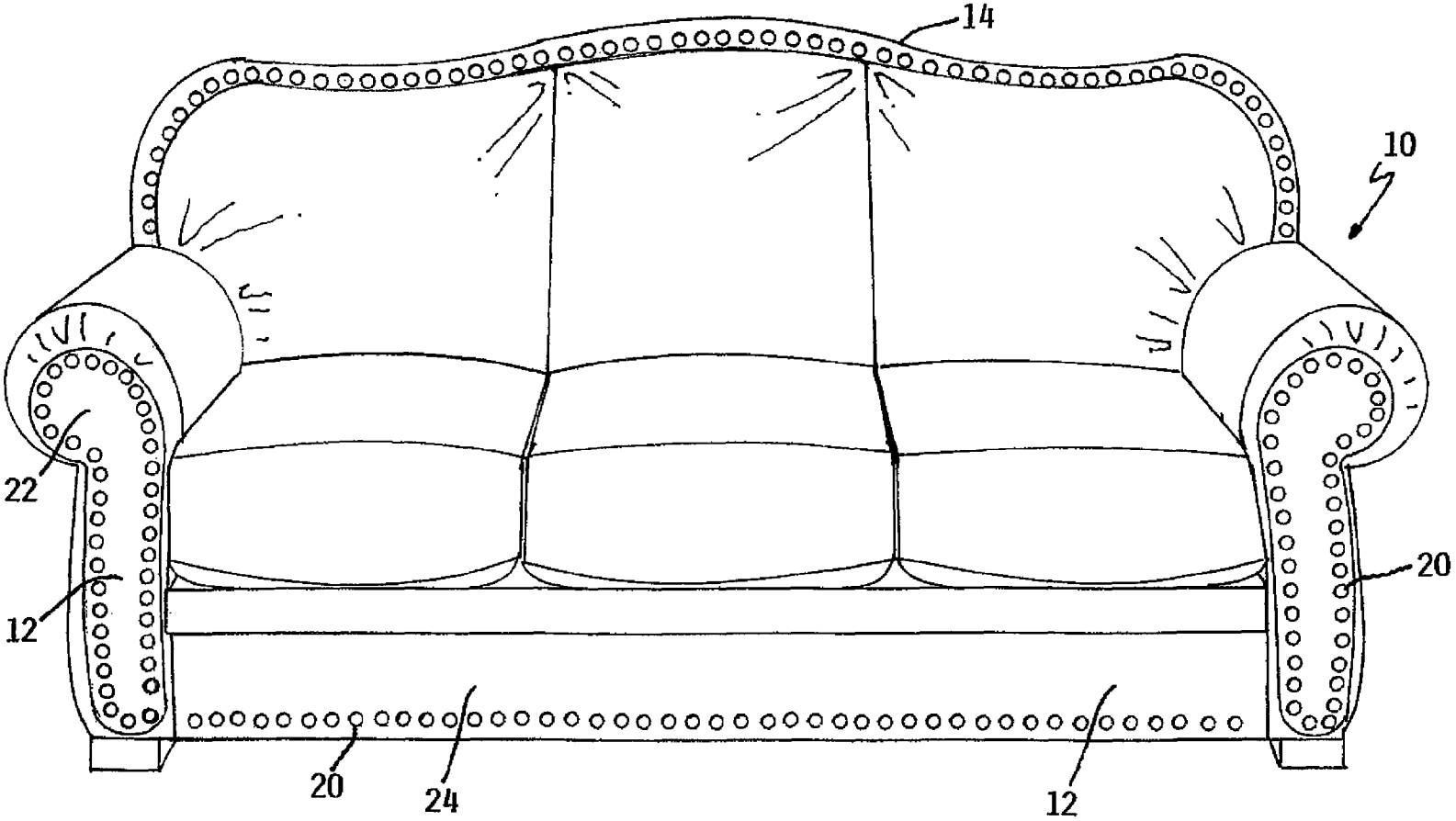
FIG. 1 is a front view of a furniture product comprising panel with decorative fasteners according to the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE INVENTION

FIG. 1 illustrate an assembled furniture product 10, in this example, a sofa, wherein the sofa includes upholstered components, specifically panels 12 and a covering 14, having decorative fasteners 20 along the arm panels, top back rail and, optionally, the front rails. The decorative fasteners 20 provide the sofa with an aesthetically pleasing appearance. Further, the decorative fasteners 20 not only provide a pleasing appearance; the decorative fasteners 20 can perform the function of affixing and holding the covering material in place on the furniture product. Typically there are a multiplicity of fasteners with exposed heads on each component. "Multiplicity" when used herein means more than a dozen.

Figure 2A:
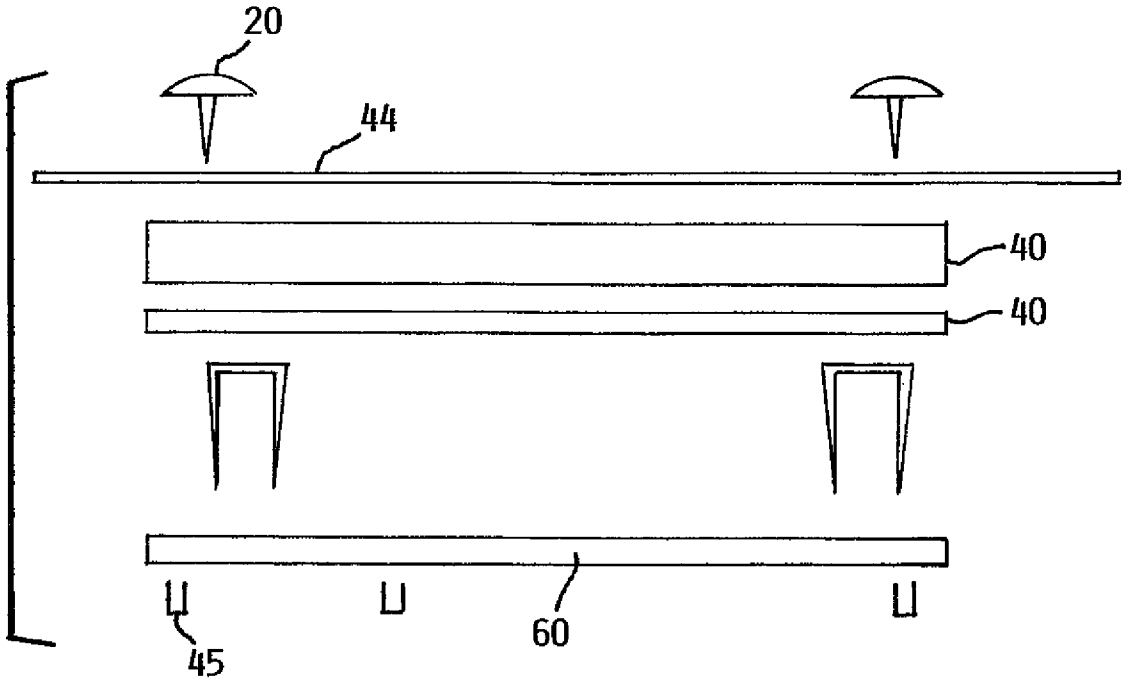
FIG. 2*a* is an exploded view of a upholstered furniture component with decorative fasteners according to embodiments of the invention.
Figure 2B:
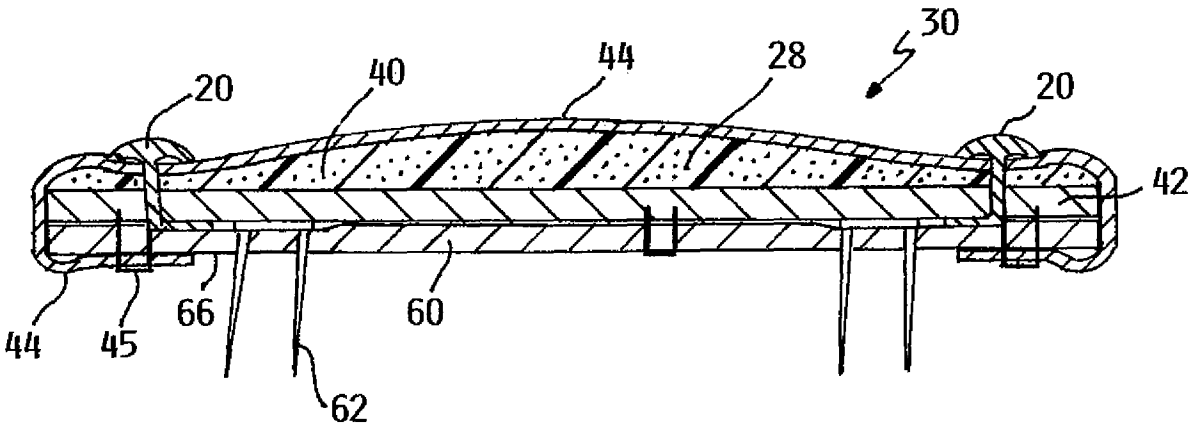
FIG. 2*b* is cross-sectional view of a upholstered furniture component with decorative fasteners according to embodiments of the invention.

The furniture product comprises a number of components, for example, a sofa arm front panel 22 or a rail panel 24. The sofa arm front panel comprises a layered composition 28, shown in cross-section and exploded at FIGS. 2*a* and 2*b*. The decorative fasteners 20 are affixed to the layered composition 28, holding various layers of the layered composition together. An additional member, a backer board 60, may be mated to the layered composition 28, providing a substrate for pronged fasteners 33 for insertion into the sofa frame.

The covering material layer 44 of the layered composition is pulled tightly around the layered composition and backer board 60, and tacked to the back of the backer board 60, with staples 45 or the like, resulting in a completed assembly. If no backer board 60 is used, the covering material layer 44 of the layered composition is pulled tightly around the layered composition and tacked to the back of the layered composition, resulting in a finished layered assembly ready for shipment. The layered assembly can be, for example, a sofa arm panel, a chair arm panel, or a front rail panel.

As illustrated in FIG. 1, decorative fasteners 20 can be used at various locations on the upholstered furniture product 10, for example, the arm panels, the top back rail, and the front rails. Decorative fasteners 20, for example, rivets, nails, tacks, or brads, can be used at one or all of these and other locations on the furniture product. By way of example, the use of decorative fasteners 20 on an arm panel is described below, as one embodiment of the invention. However, other embodiments are contemplated.

FIGS. 2*a*, 2*b*, 3 and 4 illustrate an embodiment of the constituent parts of a furniture arm panel 30. The arm panel 30 comprises a foam material layer 40, a self supporting, bendable underlayment material layer 42 such as a fibrous material or thin wood or wood product panel capable of receiving and retainer fasteners such as staples, and a covering material layer 44. However, other constructions are contemplated. The foam material layer 40, underlayment material layer 42, and covering material layer 44 are generally similarly shaped and can be of slightly different sizes. It is desirable that the underlayment material 42 include the characteristics of being slightly bendable and flexible without the underlayment material 42 fracturing. A covering material layer 44, to be used as upholstery, is selected from the group of materials including leather, imitation leather, polyvinylchloride (PVC), woven and nonwoven fabric material, and the like.

Generally, an underlayment material layer 42 forms the bottom layer or base layer of the layered composition. An underlayment material layer 42 is formed into a desired shape, for example, the shape of an arm panel 30. A foam material layer 40 is formed into a shape similar to the underlayment material layer 42 shape. Hence, in this example, the foam material layer 40 is also configured into the shape of an arm panel 30. The foam material layer 40 is positioned on top of the underlayment material layer 42. Preferably, the foam material layer 40 is laminated to the underlayment material layer 42. Various adhesive systems are known in the art that can accomplish this lamination, adhering the foam material layer 40 to the underlayment material layer 42. However, other fastening systems can be used, for example, staples. A covering material layer 44 is configured into a shape similar to the shape of the foam material layer 40 and the underlayment material layer 42.

Figure 4:
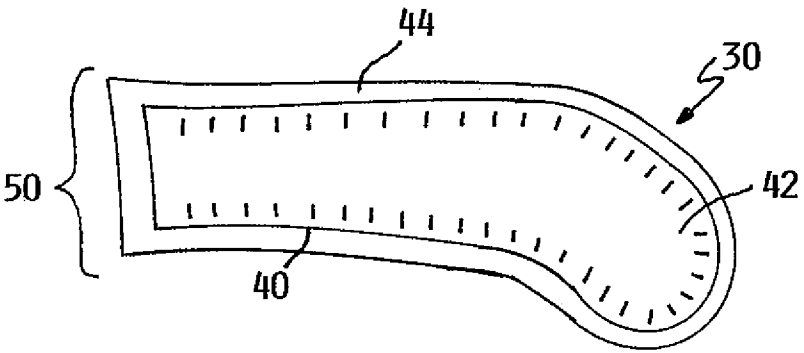
FIG. 4 is a top plan view of components of an arm panel.
Figure 3:
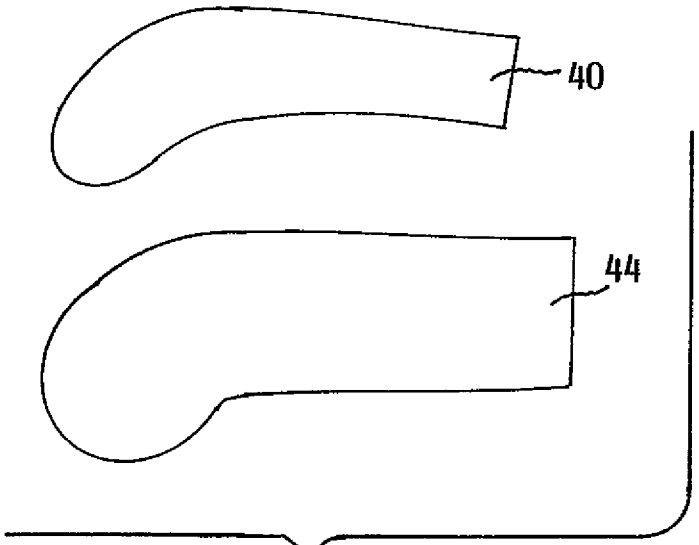
FIG. 3 is a top plan view of components of an arm panel.
Figure 6:
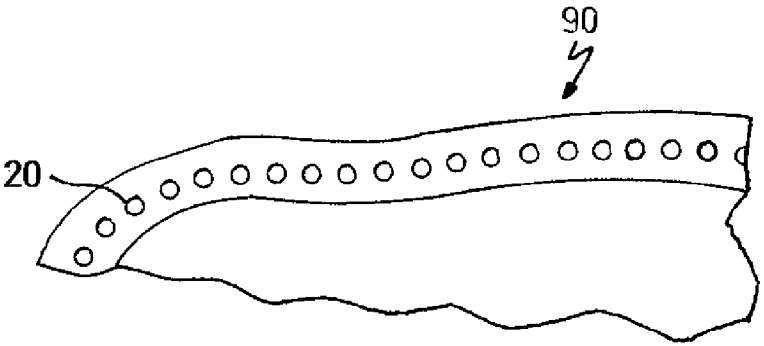
FIG. 6 is a top view of an upholstery cover comprising a plurality of decorative fasteners.
Figure 5:
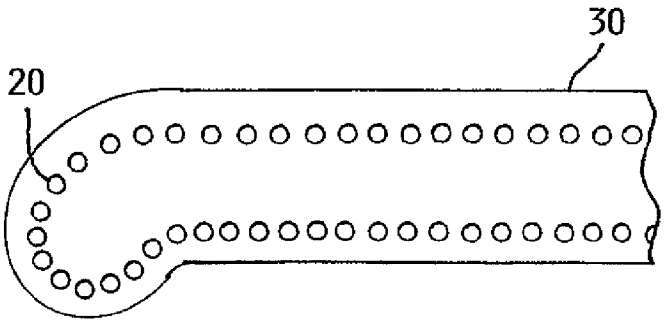
FIG. 5 is a top plan view of an arm panel comprising a plurality of decorative fasteners.
Figure 7:
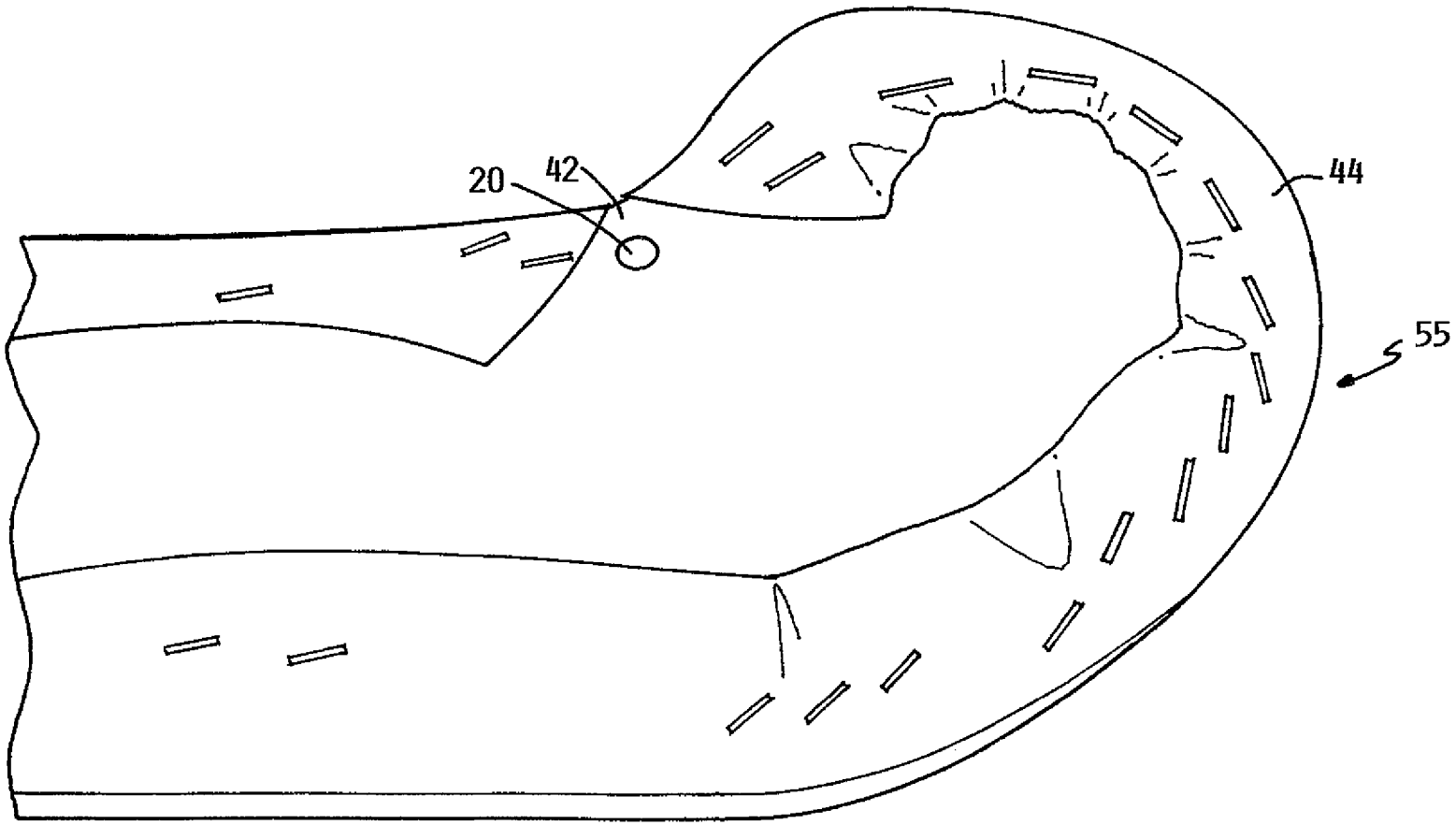
FIG. 7 is a bottom plan view of an assembled arm panel, showing the back of an affixed decorative rivet.
Figure 8:
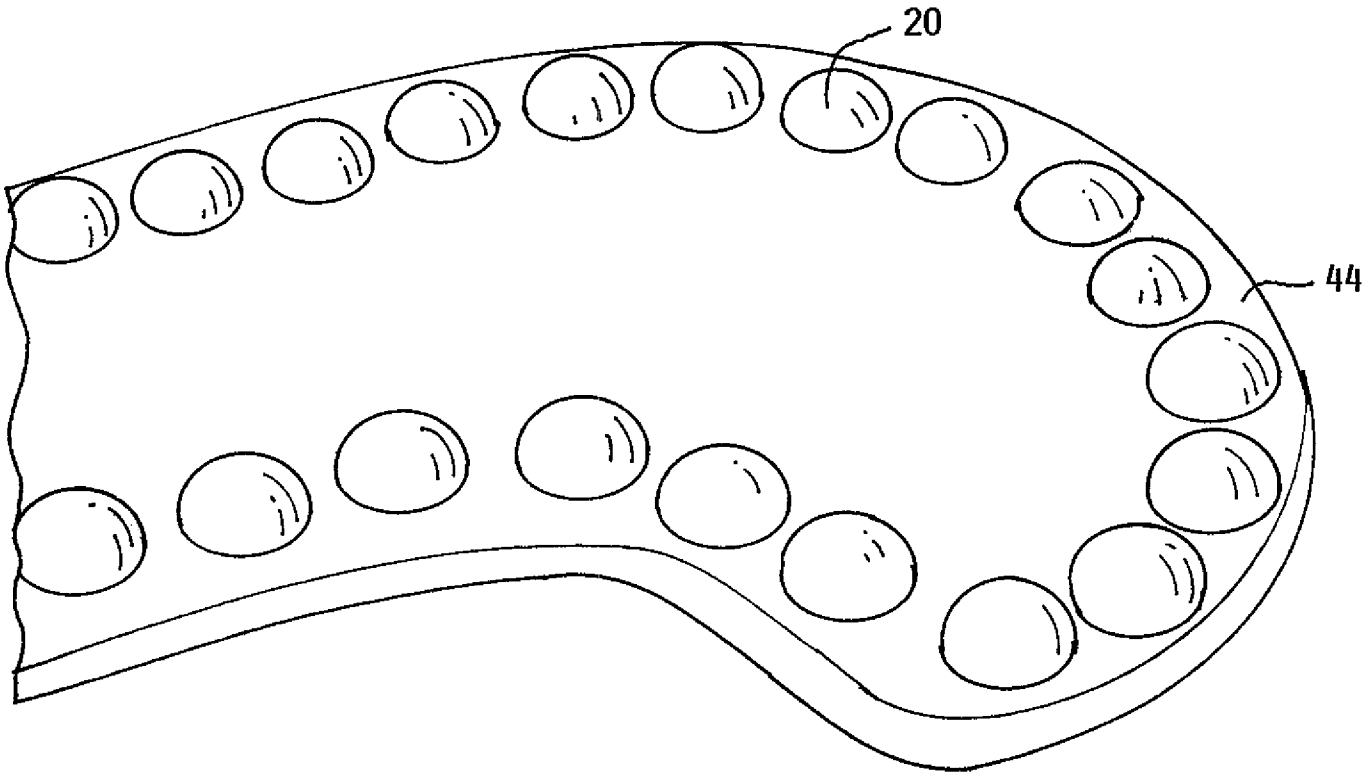
FIG. 8 is a perspective view of an assembled arm panel, showing the cap of an affixed decorative rivet.
Figure 9:
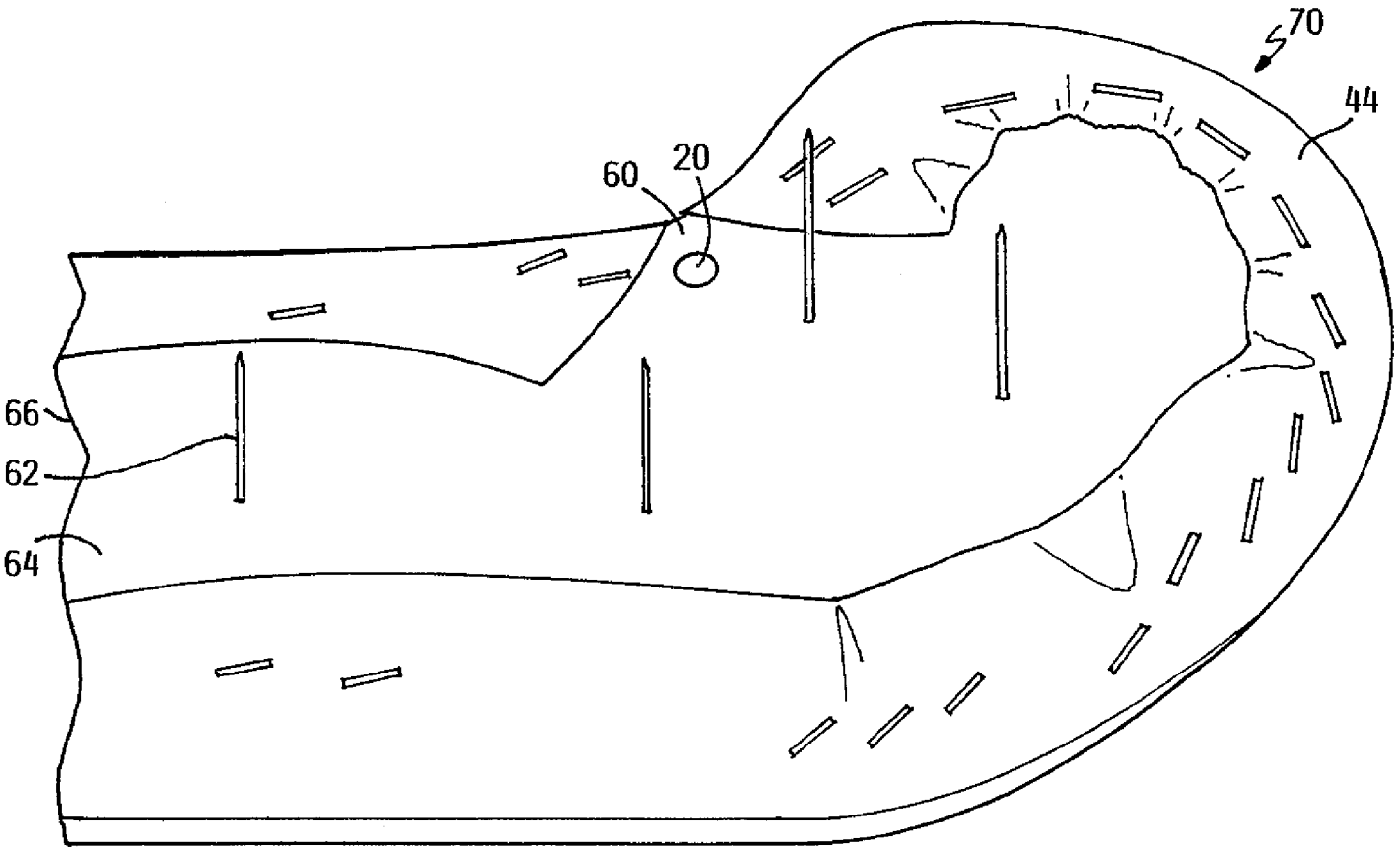
FIG. 9 is bottom plan view of an assembled arm panel, showing the back of a backer board.
Figure 10A:
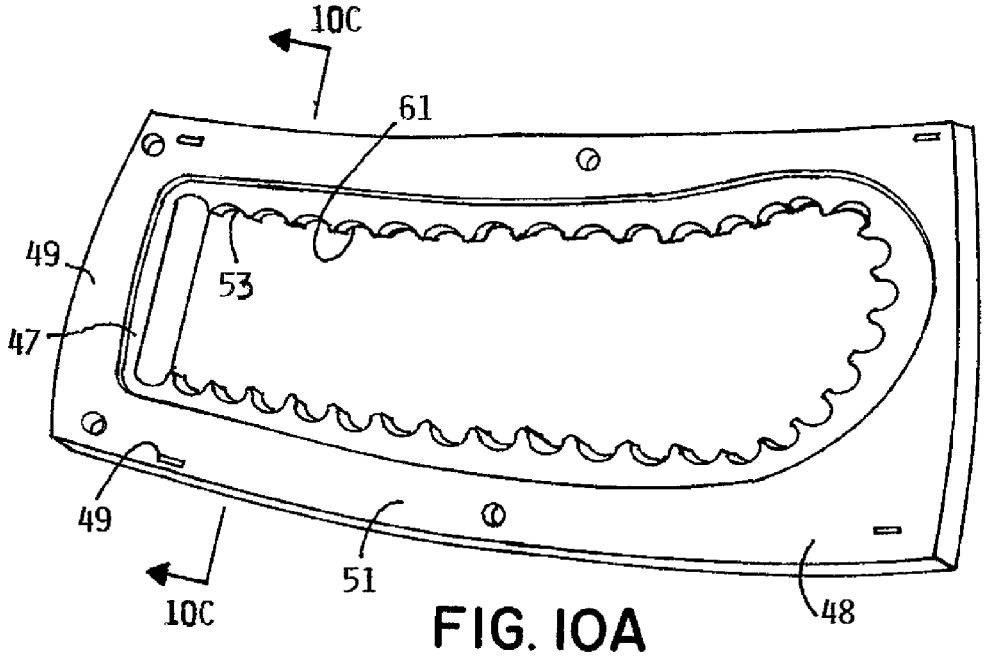
FIG. 10*a* is a perspective view of a template or template in accord with embodiments of the invention.
Figure 10B:
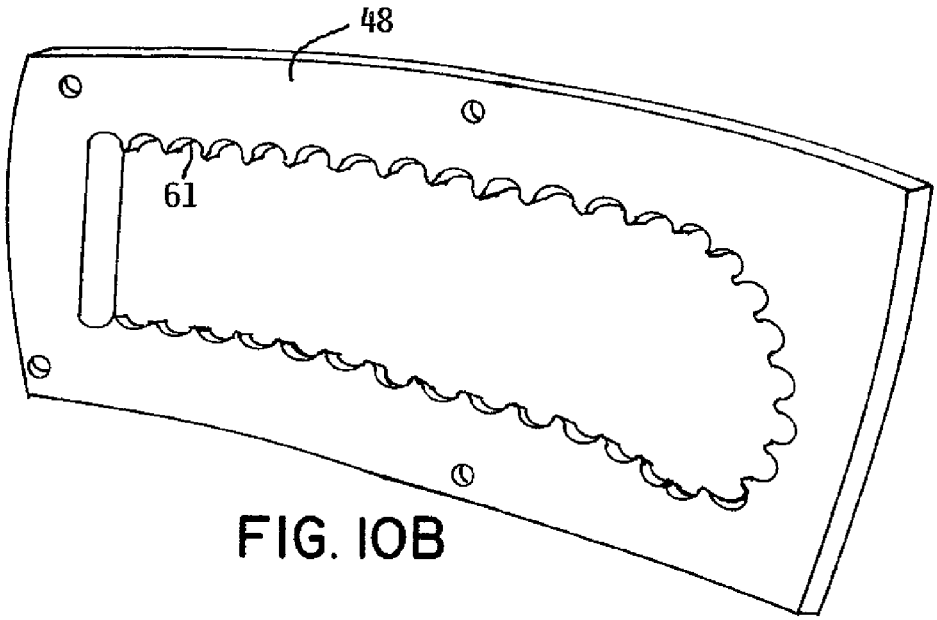
FIG. 10*b* is a perspective view of a template or template in accord with embodiments of the invention.
Figure 10C:
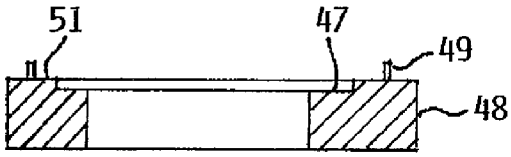
FIG. 10*c* is a cross-sectional view of a template or template in accord with embodiments of the invention taken at line 10*c*-10*c* of FIG. 10*a*.

Referring to FIG. 4, the combination underlayment material layer 42 and foam material layer 40 are placed on the covering material layer 44, so that the foam material layer 42 is in contact with the covering material layer 44, leaving the underlayment material layer 42 visible and as the bottom layer of the completed layered composition. A covering material layer 44 is positioned on top of the foam component 40. Hence, a layered composition comprises a covering material layer 44 on top of a foam material layer 40, on top of an underlayment material layer 42. However, other layers and sequence of layers are contemplated.

Figure 12A:
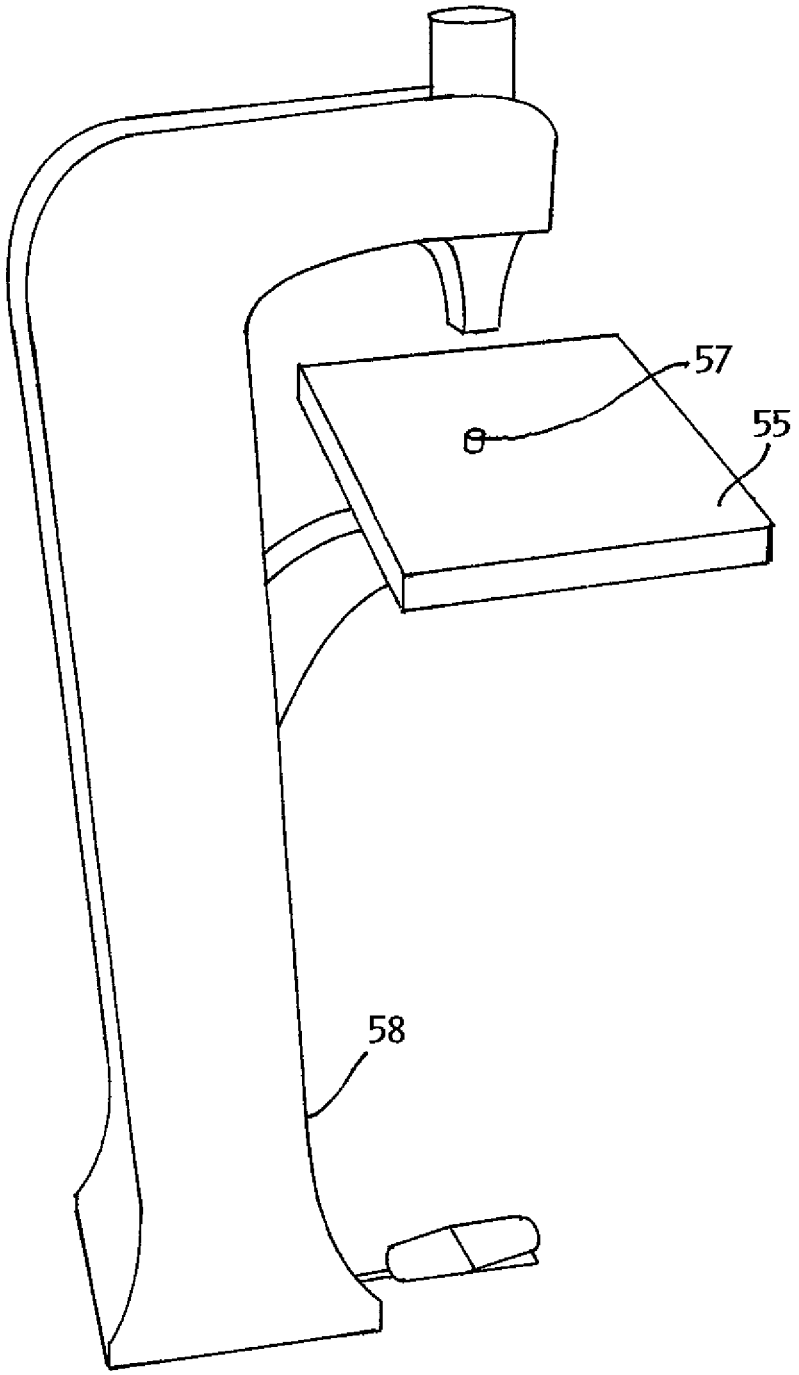
FIG. 12*a* is a perspective view of a powered fastener applicator for practicing embodiments of the invention.
Figure 12B:
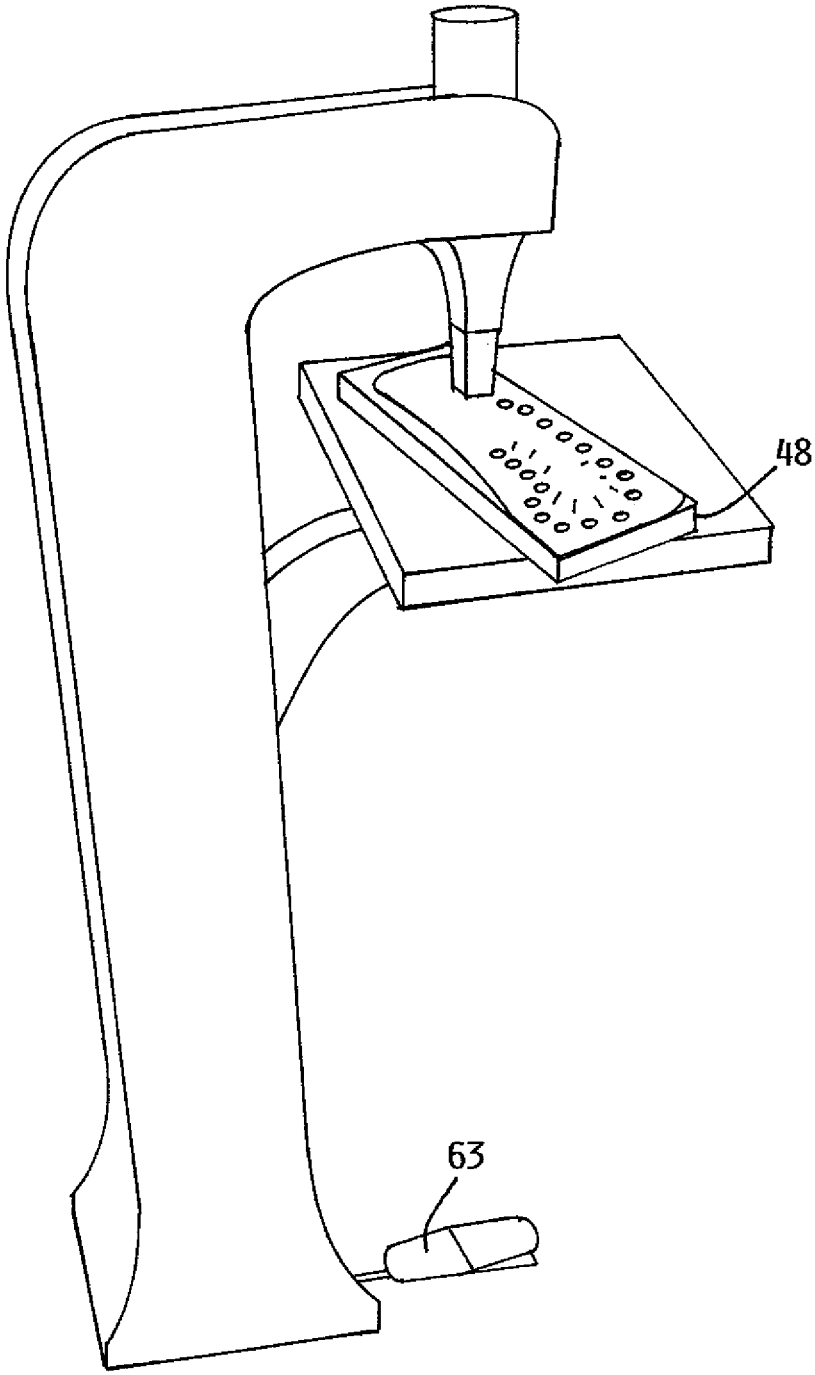
FIG. 12*b* is a perspective view of the powered fastener applicator of FIG. 12 with a template having a component being assembled therein.

The joined or layered foam material layer 40 and underlayment material layer 42 may be placed in a template 48. The joined material is positioned so that the foam material layer 40 is facing outward, so that when the covering material layer 44 is applied to the template 48, at a recess 47, the foam material layer 40 is in direct contact with the covering material layer 44. The covering material 44 is placed over the template 48 and is temporarily affixed to the template 48 by way of prongs 49 or barbs extending from the top side 51 of the template or other such structure that grabs and holds the covering material layer 44 temporarily in place. The template 48 has a pattern 53 configured to assist in proper placement of fasteners accurately and efficiently. The template 48, with the underlayment material layer 42, the foam material layer 40 and the covering material layer 44 is placed in an apparatus, a powered fastener applicator 58 adapted to affix decorative fasteners 20. The applicator 58 may have a working table 55 and a engagement guide 57. The positioning of the decorative fasteners 20 is guided by the template 48 with the pattern 53 engaging the engagement guide 57. An operator may manually move the template while it rests on the table as illustrated in FIG. 12*b* so that the scallops 61 engage the engagement guide and then operates the foot pedal actuator 63 that projects the nail with the rounded decorative head or other fastener into the layered composition thereby joining the laminated foam layer 40 and underlayment material layer 42 to the covering material layer 44. The operator then moves the template so that the next scallop engages the engagement guide on the table, activates the fastening, and so on . . . . Once the desired number and pattern of decorative fasteners 20 is affixed, joining the foam material layer 40, underlayment material layer 42 and covering material layer 44, the resulting layered component 50 may be removed from the template 48. Additional materials and/or layers to the layered component 50 are contemplated, dependent on the needs and requirements of the furniture product.

For example, a backer board 60 may be prepared separately from the layered component 50. The backer board 60 comprises a fibrous material, for example, a cardboard material or wood fiber, thin wood or wood product. Further, the backer board 60 mirrors the shape of the layered component 50, and is to be affixed to the layered component 50. Spaced fasteners 62 may be attached to the backer board 60, such that the prongs of the fasteners protrude from one side 64 of the backer board 60, and the other side 66 of the backer board 60 is relatively smooth, without protruding prongs. The fasteners 62 are, for example, as disclosed in U.S. Pat. No. 4,559,683 to Webb, which is hereby incorporated by reference, whereby the panel can be affixed to the furniture product. These fasteners are known in the furniture manufacturing industry.

The backer board 60 is placed on the layered component 50 such that the underlayment material layer 42 of the layered component 50 is mated to the relatively smooth side 66 of the backer board 60. The two surfaces 42, 66, can be adhered together. Preferably fasteners, for example, staples 45, are used to mate the backer board 60 to the layered component 50. Once the backer board 60 and the layered component 50 are mated to form the layered assembly 70, excess covering material 44 is stretched around the edges of the layered assembly 70 and affixed to the exposed surface 66 of the backer board 60. In this example, staples are used to affix the excess covering material 44 to the exposed surface 66 of the backer board 60, but other fastening methods are contemplated. The finished layered assembly 70 is ready to be shipped or to be applied to the furniture product. The layered assembly can be, for example, a sofa arm panel, a chair arm panel, a sofa front rail panel, or a chair front rail panel.

The decorative fasteners 20 utilized to affix the covering material layer 44 to the foam material layer 40 and the underlayment material layer 42 is a nail-type fastener 20 or a rivet-type fastener 20. The rivet-type fastener 20 can be a one-component fastener or a two-component fastener. For example, if a two component decorative rivet fastener 20 is used, the decorative cap portion of the decorative rivet 20 is positioned on top of the covering material layer 44, with the decorative cap portion of the rivet 20 on view. An underside of the decorative cap defines a cavity or at least one aperture wherein a shank portion of the decorative rivet 20 is receivable. A shank portion of the decorative rivet 20 is passed through the underlayment material layer 42, the foam material layer 40, the covering material layer 44, and is mated to the decorative cap. If a one-component decorative rivet 20 is used, the rivet acts like a punch, and the shank pierces the covering material layer 44, the foam material layer 40 and the underlayment material layer 42. The force on the decorative rivet 20 causes the shank to flare, retaining the decorative rivet 20 and securing it in place.

The nail-type fastener 20 also includes a decorative cap and a tapered shaft. When the nail-type fastener is affixed to the underlayment material layer 42, the foam material layer 40, and the covering material layer 44, the tapered shaft pierces all the layers, and the end of the shaft is bent by an appropriate tooling in the engagement guide on the applicator 58 to lay against the underlayment compressing or pinching the layered assembly together. The decorative fasteners 20 affixed to the layered assembly 70 forming the upholstered component, for example, a sofa arm panel, generally forming a desired pattern of decorative fastener caps on the exterior of the panel.

The decorative fastener, as noted above, includes a decorative cap or rounded decorative head. Generally, the diameter of the cap or head of the fastener used ranges from about ¼ inch to about 2.0 inches. Preferably, the diameter of the cap of the fastener ranges from ⅜ inch to about 1 inch. The size of the cap of the fastener used can be dependent upon a number of factors, including but limited to, the use of the fastener, the size of the furniture piece, the location of the fastener, and the aesthetic appearance desired. Further, the length of the shaft of the fastener can vary, for example, dependent of the thickness of the construction materials used.

In another embodiment of the present invention, the layered component 50 is made as described above. However, a backer board 60 is not affixed to the layered component 50. Instead, the excess covering material layer 44 is stretched around the edges of the layered component 50 and affixed to the exposed surface of the underlayment material layer 42, forming a finished layered assembly 55. The excess covering material layer 44 can be adhered to the exposed surface of the underlayment material layer 42 or fastened to the exposed surface of the underlayment material layer 42, for example, by staples. The finished layered assembly 55 is ready to be shipped or to be applied to the furniture product. The layered assembly can be, for example, a sofa arm panel, a chair arm panel, a sofa front rail panel, or a chair front rail panel. Additional fasteners are required to affix the finished layered assembly 55 to the furniture product.

Figure 11:
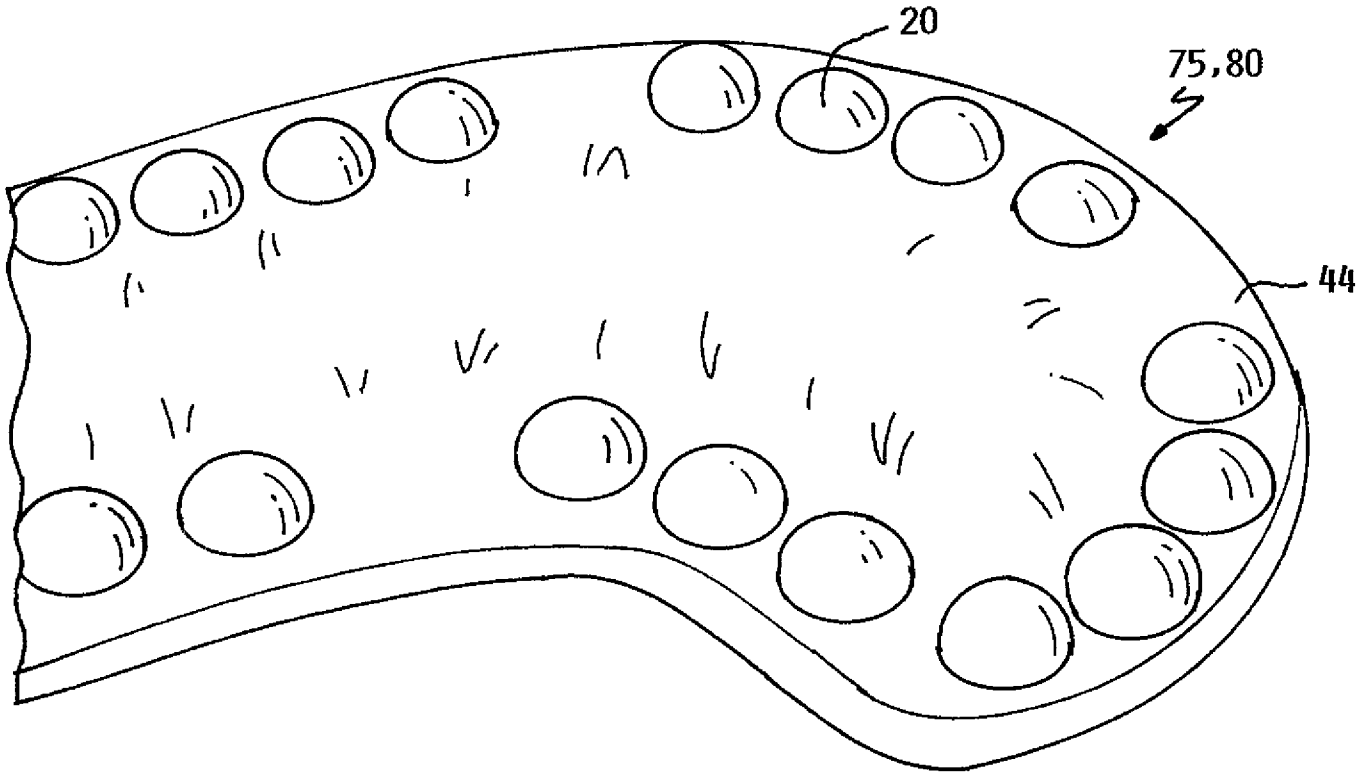
FIG. 11 is a perspective view of a layered assembly, showing vacant locations for fasteners, to be affixed when the layered assembly is affixed to the furniture product according to embodiments of the invention.

Referring to FIG. 11, in another embodiment of the present invention, a plurality of positions that would ordinarily be held by decorative fasteners 20 on the layered component 50 are left vacant, yet the layered component 50 remains intact. The layered component 50 comprises the underlayment material layer 42, the foam material layer 40, the covering material layer 44, and the fasteners 20. The excess covering material layer 44 is stretched around the edges of the layered component 50 and tacked to the exposed surface of the underlayment material layer 42. The excess covering material layer 44 can be adhered to the underlayment material layer 42, or fasteners, for example, staples, are used to fasten the excess covering material to the underlayment material layer 42. The layered assembly 75 can be used immediately, stored, or shipped for further use elsewhere. Optionally, a backer board is affixed to the underlayment material layer 42. In this instance, the excess covering material layer 44 is stretched around the edges of the layered component 50 and affixed to the backer board 60. The layered assembly 80, so constructed, is ready to be transported, stored for future use, or used promptly.

When the layered assembly 75, 80 is ready to be used, the layered assembly is positioned at the proper location on the furniture product and decorative fasteners 20 that are capable of affixing the layered assembly 75, 80 to the furniture product, are used to secure the layered assembly 75, 80. The caps of the various fasteners 20 used are identical so that it may be difficult to discern, in the finished furniture product, which fastener 20 was applied at which time. Alternatively, differently capped fasteners can be used to provide an accent to the previously affixed fasteners. Hence, a pre-assembled decorative panel can be supplied for inclusion in a finished furniture product.

Although an arm panel has been described as an example utilizing the instant invention, other panels for use in furniture products are contemplated. For example, sofa top back rails, sofa front rails and chair front rails can be produced utilizing the described disclosure.

In another embodiment, an upholstery cover 90 for, for example, a chair, is supplied wherein the upholstery cover 90 comprises a plurality of decorative rivets 20. The upholstery cover 90 for the back of a chair comprises a plurality of shaped cover material 44 pieces stitched together to form the upholstery cover 90. The upholstery cover 90 is designed to fit over cushioning material on the back of a chair and to be affixed to the back top of a chair frame. It is desired that a plurality of decorative fasteners be positioned along the back top of a chair, to provide for an aesthetically pleasing furniture product.

The portion of the upholstery cover 90 that is to be positioned at the back top of the chair frame is identified, and a layered composition of a foam material layer 40 and an underlayment material layer 42 is affixed to the inside surface of the upholstery cover 90, that is the inside surface of the material covering 44, at the desired location. The layered composition can be affixed to the proper location on the upholstery cover 90 after the upholstery cover 90 has been produced or, alternatively, the layered composition can be affixed to the upholstery cover 90 during production of the upholstery cover 90.

An underlayment material layer 42 is formed into a desired shape, such as an elongated strip to follow the profile of the back top of a chair. A foam material layer 40 is formed into a shape matching the underlayment material layer 42 shape. Hence, the foam material layer 40 can also be configured into the shape of an elongated strip. The foam material layer 40 is positioned on top of the underlayment material layer 42. Preferably, the foam material layer 40 is laminated to the underlayment material layer 42. Various adhesive systems are known in the art that can accomplish this lamination, adhering the foam material layer 40 to the underpayment material layer 42. This two-layered composition comprising a foam material layer 40 and an underlayment material layer 42 is positioned at the desired location on the underside of the covering material 44 composing the upholstery cover 90, such that a layered composition comprising a covering material 44 layer on top of a foam material layer 40, on top of an underlayment material layer 42 is produced. The covering material layer 44, the foam material layer 40, and the underlayment material layer 42 are held together by a plurality of decorative fasteners 20. Additional materials and/or layers to the layered composition are contemplated, dependent on the needs and requirements of the furniture product.

The decorative fasteners 20 utilized to affix the covering material layer 44 to the foam material layer 40 and the underlayment material layer 42 is a nail-type fastener or a rivet-type fastener 20. The rivet-type fastener 20 can be a one-component fastener or a two-component fastener. For example, if a two component decorative rivet fastener 20 is used, the decorative cap portion of the decorative rivet 20 is positioned on top of the covering material layer 44, with the decorative cap portion of the rivet 20 on view. An underside of the decorative cap defines a cavity or at least one aperture wherein a shank portion of the decorative rivet 20 is receivable. A shank portion of the decorative rivet 20 is passed through the underlayment material layer 42, the foam material layer 40, the covering material layer 44, and is mated to the decorative cap. If a one-component decorative rivet 20 is used, the rivet acts like a punch, and the shank pierces the covering material layer 44, the foam material layer 40 and the underlayment layer 42. The force on the decorative rivet 20 causes the shank to flare, retaining the decorative rivet 20 and securing it in place.

The nail-type fastener 20 also includes a decorative cap and a tapered shaft. When the nail-type fastener is affixed to the underlayment material layer 42, the foam material layer 40, and the covering material layer 44, the tapered shaft pierces all the layers, and the end of the shaft is bent so that the shaft tip penetrates the exposed surface of the underlayment material layer 42 without affecting the covering material layer 44.

The decorative fasteners 20 are affixed to the layered composition, generally forming a desired pattern of decorative fastener caps on the exterior of the upholstery cover 90. The upholstery cover 90, so constructed, can be transported, stored for future use, or used promptly. The upholstery cover 90 is then affixed to the furniture frame.

However, a plurality of positions that should be held by decorative fasteners 20 can be left vacant, yet the layered composition remains intact. The upholstery cover 90 can be transported, stored for future use, or used promptly. When the upholstery cover 90 is ready to be used, the upholstery cover 90 is positioned at the proper location on the chair and chair cushions. Decorative fasteners 20 that are capable of affixing the upholstery cover 90 to the chair frame, for example, decorative nails or tacks, are used to secure the upholstery cover 90 to the frame. The caps of the various fasteners 20 used can be identical so that it can be difficult to discern, in the finished furniture product, which fastener 20 was applied at which time. Alternatively, if all of the required decorative fasteners 20 are initially applied, then fasteners that are not discernable from the exterior of the furniture product can be used to affix the upholstery cover 90 to the frame. Hence, a pre-assembled decorative upholstery cover 90 can be supplied for inclusion in a finished furniture product.

The foregoing is considered as illustrative only of the principles of the disclosure. Further, since numerous changes and modifications will readily occur to those skilled in the art, it is not desired to limit the disclosure to the exact construction and operation shown and described, and accordingly, all such suitable changes or modifications in structure or operation which may be resorted to are intended to fall within the scope of the claimed disclosure.

While the description of the disclosure is amenable to various modifications and alternative forms, specifics thereof have been shown by way of example in the drawings and have been described in detail. It should be understood, however, that the description of the disclosure is not to limit the disclosure to the particular embodiments described. On the contrary, the intention is to cover all modifications, equivalents, and alternatives.

I claim:

1. A preassembled upholstered component for assembly of an upholstered seat, the upholstered seat having a wood seat frame, the preassembled upholstered component for placement on the front face of the upholstered seat, the preassembled upholstered component having a front side and a back side, and a panelar geometric shape with an edge, the component comprising a backer board at the backside with the geometric shape, a panel with the geometric shape positioned adjacent to the backer board, a foam material layer opposite the panel from the backer board, and a upholstery covering on the front side adjacent the foam material layer and covering the foam material layer, a multiplicity of decorative metallic fasteners with rounded fastener heads exposed on the front side and arranged in a series to follow the geometric shape, a central area that bulges outwardly on the front side from cushion material below the upholstery covering, the component secured together by the multiplicity of decorative metallic fasteners with rounded fastener heads extending at least partially through the component, the multiplicity of decorative metallic fasteners not having prongs extending out the back side of the preassembled upholstered component, the upholstery covering extending over the front side and wrapped onto the back side of the component and secured thereto, and the upholstery covering attached to the component by way of the backer board, and a plurality of pronged fasteners with respective prongs extending from base components of the pronged fasteners, the base components extending transverse to the prongs, the base components sandwiched between the panel and the backer board, the prongs extending outwardly from the back side of the preassembled upholstered component for future installation of the preassembled upholstered component on a wood seat frame.

2. The component of claim 1 wherein the decorative metallic fasteners each have a tapered shaft.

3. The component of claim 2 wherein the tapered shaft of each decorative metallic fastener is bent over securing the component together.

4. The component of claim 1 wherein each of the decorative metallic, fasteners are configured as a rivet.

5. An upholstered furniture piece comprising decorative fasteners comprising:

a wood seat frame;

a layered component having a front side and a back side, the layered component comprising a backer board on the back side, an underlayment material layer panel adjacent to the backer board, a foam material layer and a covering material layer secured to the layered component by way of the backer board wherein the foam material layer is positioned between the underlayment material layer panel and the covering material layer, the layered component further comprising a multiplicity of decorative fasteners with decorative heads exposed on the front side and wherein the multiplicity of decorative fasteners affix the covering material layer to the foam material layer and underlayment layer panel, and the heads are exposed on the front of the layered component, the multiplicity of decorative fasteners not having prongs that extend into the wood seat frame, the layered component further comprising pronged fasteners with respective prongs extending from base components transverse to the prongs, the base components sandwiched between the backer board and the underlayment material layer panel, the prongs extending outwardly from the back side of the component and into the wood seat frame thereby affixing the component to the wood seat frame, the pronged fasteners with respective prongs extending into the wood seat frame, not visible on the upholstered furniture piece when the upholstered furniture piece is assembled.

6. A preassembled upholstered component for assembly of an upholstered seat; the upholstered seat having a wood seat frame, the preassembled upholstered component for placement on the front face of an arm of the upholstered seat, the preassembled upholstered component having a front side and a back side, an upholstery covering and a panelar geometric shape with an edge, the upholstery covering extending over the front side and wrapped onto the back side of the component and attached to a backer hoard, a panel with the geometric shape positioned next to and forwardly of the backer board, a plurality of pronged fasteners with respective prongs, each prong extending from a base component that extends transverse to the prong, the base component sandwiched between panel and the backer board, the prongs extending through the backer board and outwardly from the back side of the preassembled upholstered component for future installation of the preassembled upholstered component on a wood seat frame, the plurality of pronged fasteners each have a base component engaged with a board within the component thereby securing the pronged fastener to the preassembled upholstered component, the plurality of pronged fasteners not visible on the front side of the preassembled upholstered component.

7. The preassembled upholstered component for assembly of an upholstered seat of claim 6 further comprising it multiplicity of decorative rounded heads arranged along the edge, the multiplicity of decorative rounded heads not associated with any prongs extending outwardly from the hack side of the upholstered component.

* * * * *

UNITED STATES PATENT AND TRADEMARK OFFICE

CERTIFICATE OF CORRECTION

PATENT NO. : 8,764,115 B2
APPLICATION NO. : 12/138328
DATED : July 1, 2014
INVENTOR(S) : Brandtner It is certified that error appears in the above-identified patent and that said Letters Patent is hereby corrected as shown below:

In the Claims

In Col. 13, Line 36, in Claim 4, delete “metallic,” and insert -- metallic --, therefor.

In Col. 14, Line 4, in Claim 5, delete “layer panel,” and insert -- layer panel --, therefor.

In Col. 14, Line 20, in Claim 6, delete “seat; the” and insert -- seat, the --, therefor.

In Col. 14, Line 27, in Claim 6, delete “hoard,” and insert -- board, --, therefor.

In Col. 14, Line 32, in Claim 6, delete “between panel” and insert -- between the panel --, therefor.

In Col. 14, Line 43, in Claim 7, delete “comprising it” and insert -- comprising a --, therefor.

In Col. 14, Line 46, in Claim 7, delete “hack side” and insert -- back side --, therefor.

Signed and Sealed this
Seventh Day of April, 2015

Michelle K. Lee

Michelle K. Lee
*Director of the United States Patent and Trademark Office*